US006581994B2

(12) United States Patent
Stevenson

(10) Patent No.: US 6,581,994 B2
(45) Date of Patent: Jun. 24, 2003

(54) CONCRETE CHUTE SHOVEL

(76) Inventor: Mark W. Stevenson, 128 W. Putnam Ferry Rd., Woodstock, GA (US) 30189

( * ) Notice: Subject to any disclaimer, the term of this patent is extended or adjusted under 35 U.S.C. 154(b) by 0 days.

(21) Appl. No.: 09/866,295

(22) Filed: May 25, 2001

(65) Prior Publication Data

US 2002/0175525 A1 Nov. 28, 2002

(51) Int. Cl.[7] ..... B25B 33/00; B01F 15/00
(52) U.S. Cl. ..... 294/49; 294/57; 15/236.07
(58) Field of Search ..... 294/7, 19.1, 32, 294/49, 50.6, 50.8, 51, 54.5, 55, 56, 57; 15/104.03, 104.05, 105, 236.01, 236.04–236.08, 245; 30/169, 171, 277, 340, 342, 344

(56) References Cited

U.S. PATENT DOCUMENTS 1,458,039 A * 6/1923 Eiermann ..... 294/55
3,226,149 A * 12/1965 McJohnson ..... 294/49 X
3,474,535 A * 10/1969 Kramer ..... 294/49 X
3,906,632 A * 9/1975 Oppenheimer ..... 294/7 X
4,848,818 A * 7/1989 Smith ..... 294/55 X
4,850,728 A * 7/1989 Arroyo ..... 15/236.07 X
5,033,156 A * 7/1991 Stewart ..... 15/236.07 X
5,261,144 A * 11/1993 Mitchell et al. ..... 15/236.01 X
5,606,761 A * 3/1997 Lynch ..... 15/236.01 X
5,915,794 A * 6/1999 Neff ..... 30/169
5,951,077 A * 9/1999 Dahill ..... 294/49

* cited by examiner

*Primary Examiner*—Dean J. Kramer
(74) *Attorney, Agent, or Firm*—Myers & Kaplan, LLC; Joel D. Myers; Barry E. Kaplan

(57) ABSTRACT

A specialized tool for utilization within the chute of a concrete truck enabling efficient direction of liquid concrete via an elongated handle and strategically shaped, replaceable head, wherein a generally semi-circular shaped head facilitates compatibility with the discharge chute of a cement truck for assisting in the direction and placement of concrete, an elongated handle facilitates an extended reach into the discharge chute of a cement truck for shoveling, pulling, plugging or otherwise controlling the flow of concrete and a replaceable blade head provides long-term efficient usage thereof, thereby enabling a user to efficiently deposit, apply and manage fresh liquid concrete from a concrete truck's chute as the concrete is being discharged.

13 Claims, 5 Drawing Sheets

CONCRETE CHUTE SHOVEL

TECHNICAL FIELD

The present invention relates generally to trowel-type tools and, more specifically, to a specialized concrete chute shovel for use in the discharge chute of a concrete truck, the shovel having a generally semi-circular shaped head and an elongated handle. The present invention is particularly useful in, although not strictly limited to, concrete discharge applications wherein an individual desires to assist in the direction and placement of concrete by reaching into the elongated discharge chute of a concrete truck and controlling the flow of concrete by shoveling, pulling, sweeping and/or plugging the flow of concrete.

BACKGROUND OF THE INVENTION

It is common practice in the concrete installation industry to have a worker utilize an implement of some sort to assist in the direction of fresh concrete as it is discharged down the elongated chute of a concrete truck. Makeshift tools are often improvised at a job site, wherein a worker may employ a length of scrap wood, pipe or metal. Other available tools that have also been utilized include square head shovels, spade type shovels, hoes and rakes.

Each of the aforementioned tools or devices is inherently inefficient and thus disadvantageous, wherein the shape thereof is not complementary to that of a chute of a concrete truck. Repeated strokes are necessitated to effectively influence the movement of fresh liquid concrete in a chute. These incompatibly shaped tools disadvantageously increase the amount of work energy required to scoop a substantial portion of concrete within a chute.

In addition, concrete is prone to build up on the utilized implements over time. Wherein work site tools are employed to direct fresh concrete in a truck chute, the tools may become unusable for other purposes. So dedicated, the concrete laden tools continue to become increasingly heavy, more inefficient and finally must be discarded. Such continual replacement of tools is financially disadvantageous.

Therefore, it is readily apparent that there is a need for a concrete chute shovel apparatus having a generally semi-circular shaped head enabling compatibility with the discharge chute of a cement truck, an elongated handle enabling extended reach into the discharge chute of a cement truck and a replaceable blade head enabling long-term efficient usage thereof, thus preventing the above-discussed disadvantages.

BRIEF SUMMARY OF THE INVENTION

Briefly described, in a preferred embodiment, the present invention overcomes the above-mentioned disadvantages, and meets the recognized need for such a device, by providing a concrete chute shovel device enabling efficient direction of liquid concrete via an elongated handle and strategically shaped, replaceable/disposable head.

According to its major aspects and broadly stated, the present invention is a specialized shovel apparatus having a generally semi-circular shaped head facilitating compatibility with the discharge chute of a cement truck for assisting in the direction and placement of concrete, an elongated handle facilitating extended reach into the discharge chute of a cement truck for shoveling, pulling, plugging or otherwise controlling the flow of concrete and a replaceable blade head providing long-term efficient usage thereof, thereby enabling a user to efficiently deposit, apply and manage fresh liquid concrete from a concrete truck's chute as the concrete is being discharged.

More specifically, the present invention is a substantially flat blade having a first substantially arcuately extended edge. The dimensions of the arcuately extended edge are defined to correlate directly with the dimensions of the "U"-shaped interior of the chute of a concrete mixing and dispensing truck. Wherein telescoping lengths of a concrete truck chute may have varied interior dimensions, several sizes of the blade of the present invention are provided.

The substantially arcuately extended edge imparts a generally half-circle, or semi-circular, shape to the work end of the blade. This half-moon design makes the task of moving material, such as fresh liquid concrete, easier and simpler by matching the shape of the work chute and thereby enabling contact with all exposed surfaces thereof. The blade is preferably formed from plastic. However, one skilled in the art would readily recognize that alternative materials could be utilized such as, for exemplary purposes only, rubber, fiberglass, metal, wood or composite material.

The blade is affixed to a support member, wherein the support member is affixed to an elongated handle. The blade of the present invention may be integral to or affixed to the support member and elongated handle, however, it is preferred that the blade is removably affixed to facilitate replacement/disposal thereof. The elongated handle is substantially straight and has a fixed length. However, to accommodate potential variations in concrete chute angles, the elongated handle may be formed with at least one angled portion therein, and to accommodate potential variations in concrete chute length, the elongated handle may be telescoping.

A feature and advantage of the present invention is the ability of such a device to provide assistance in the unloading of fresh concrete.

A feature and advantage of the present invention is the ability of such a device to enable a worker to work in a more efficient manner, utilizing fewer strokes thus reducing the amount of time and effort needed for the task of moving fresh concrete in a concrete chute.

A feature and advantage of the present invention is the ability of such a device to provide a specialized tool for handling fresh concrete, wherein a disposable blade extends the useful life thereof.

A feature and advantage of the present invention is the ability of such a device to enable efficient direction and placement of liquid concrete.

A feature and advantage of the present invention is the ability of such a device to enable extended reach into the discharge chute of a cement truck for shoveling, pulling, plugging or otherwise controlling the flow of concrete.

A feature and advantage of the present invention is the ability of such a device to effectively mate with the "U"-shaped interior of the chute of a concrete mixing and dispensing truck.

A feature and advantage of the present invention is the ability of such a device to provide, in an alternative form, a specialized tool for handling fresh concrete, wherein a handle is integrally formed with a blade.

These and other objects, features and advantages of the invention will become more apparent to one skilled in the art from the following description and claims when read in light of the accompanying drawings.

BRIEF DESCRIPTION OF THE DRAWINGS

The present invention will be better understood by reading the Detailed Description of the Preferred and Alternate Embodiments with reference to the accompanying drawing figures, in which like reference numerals denote similar structure and refer to like elements throughout, and in which.

DETAILED DESCRIPTION OF THE PREFERRED AND ALTERNATE EMBODIMENTS

In describing the preferred and alternate embodiments of the present invention, as illustrated in the FIGS. and/or described herein, specific terminology is employed for the sake of clarity. The invention, however, is not intended to be limited to the specific terminology so selected, and it is to be understood that each specific element includes all technical equivalents that operate in a similar manner to accomplish similar functions.

Figure 1:
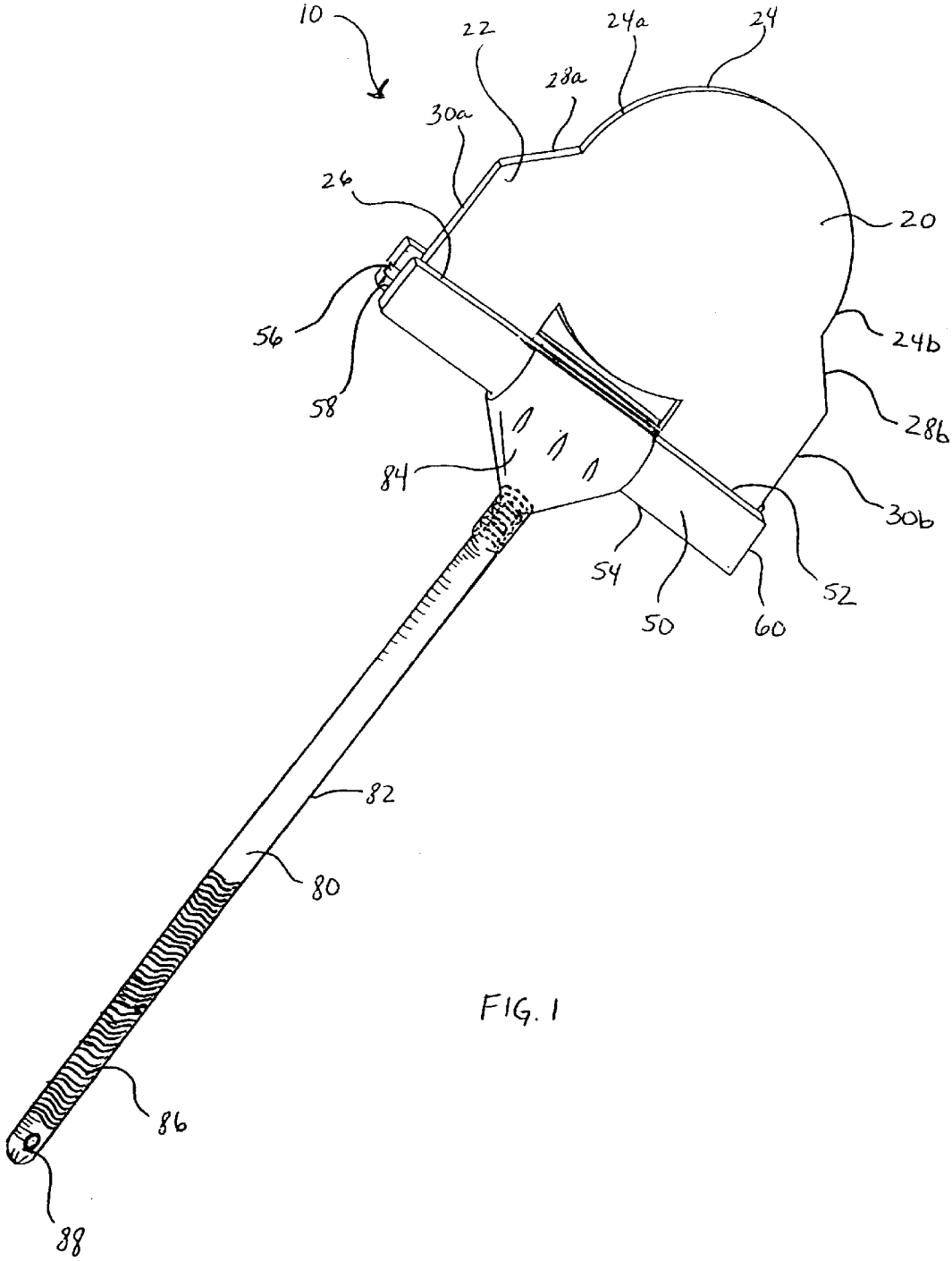
FIG. 1 is a perspective view of a concrete chute shovel apparatus according to a preferred embodiment of the present invention.
Figure 3:
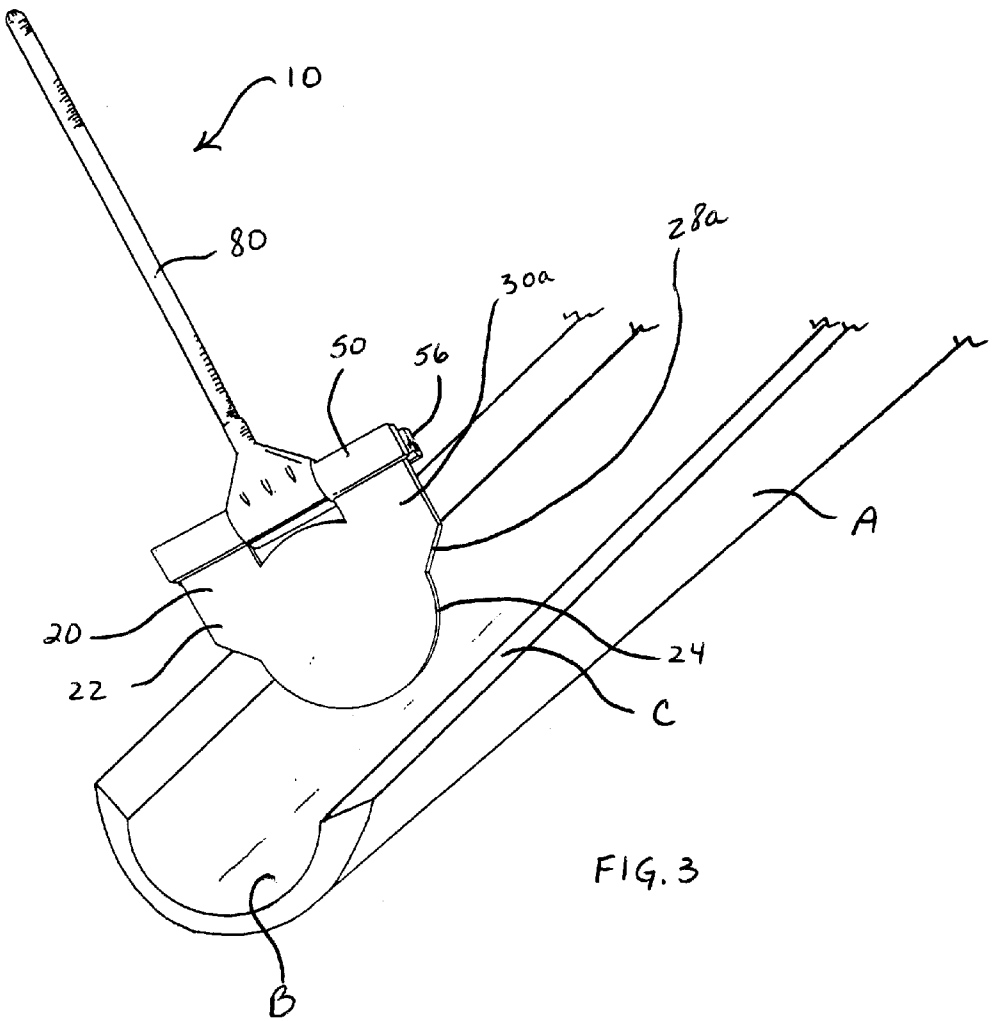
FIG. 3 is a perspective view of the concrete chute shovel apparatus of FIG. 1, showing the concrete chute shovel positioned above a trough of a cement truck dispensing chute.

Referring now to FIG. 1, the present invention is a concrete chute shovel device 10 generally comprising scoop member 20, scoop support 50 and elongated arm 80. Preferably, scoop member 20 is a substantially flat blade 22 defined by substantially arcuate extended edge 24, substantially straight support edge 26, guiding edges 28*a* and 28*b* and side edges 30*a* and 30*b*. The dimensions of first substantially arcuate extended edge 24 preferably correspond with known dimensions of substantially "U"-shaped interior B of a concrete mixing and dispensing truck chute A, as best seen in FIG. 3. Wherein telescoping or pivoting sections of a concrete truck chute have interior dimensions enabling stacked or interlocked placement thereof, several sizes of scoop member of concrete chute shovel device 10 are provided. One skilled in the art would readily recognize based on the present disclosure that while the preferred embodiment of scoop member 20 is dimensioned to correspond with the interior space of known concrete chutes, other dimensions could be utilized to correspond with other types of material troughs and dispensing chutes.

First end 24*a* and second end 24*b* of substantially arcuate extended edge 24 preferably intersect with first guiding edge 28*a* and second guiding edge 28*b*, respectively, wherein guiding edges 28*a* and 28*b* extend outwardly from substantially arcuate extended edge 24 and at an angle thereto, thereby providing a support function during use of concrete chute shovel apparatus 10 by contacting the upper edge C of the trough region B of a concrete truck chute A, as best seen in FIG. 3. First side edge 30*a* and second side edge 30*b* preferably extend, substantially straight, from outwardly angled guiding edges 28*a* and 28*b*, respectively, to substantially straight support edge 26. While the substantially straight, outwardly angled formation of guiding edges 28*a* and 28*b* is preferred, one skilled in the art would readily recognize that other formations could be utilized such as, for exemplary purposes only, a substantially straight, non-angled formation, an arcuately recessed formation, an arcuately extended formation or a grooved formation. Furthermore, scoop member 24 could be alternatively defined wherein guiding edges 28*a* and 28*b* extend, outwardly angled, to substantially straight support edge 26, thereby effectively eliminating first side edge 30*a* and second side edge 30*b*.

Figure 4:
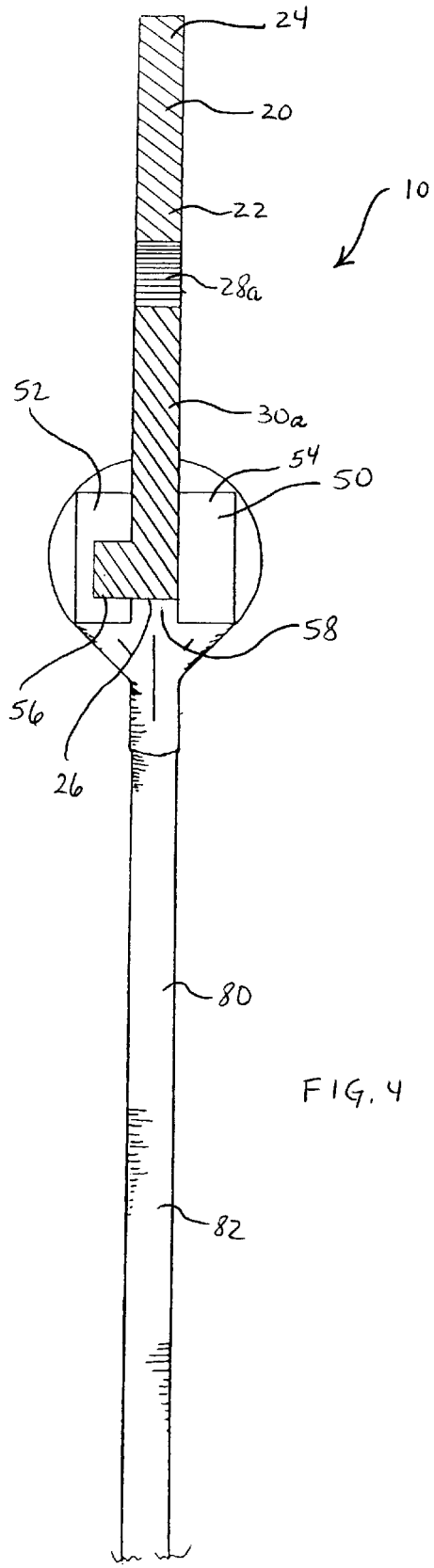
FIG. 4 is a side view of the concrete chute shovel apparatus of FIG. 1.

Preferably, substantially straight support edge 26 of scoop member 20 is removably carried by scoop support 50. Preferably, scoop support 50 is substantially rectangular or square shaped with scoop side 52 and handle side 54. Preferably, scoop side 52 is grooved, wherein the dimensions of groove 56 enable substantially straight support edge 26 of scoop member 20 to be slidably placed and held therein, as best seen in FIG. 4. Preferably, first end 58 of groove 56 permits access thereto for placement and removal of scoop member 20, wherein second end 60 of groove 56 prevents passage of scoop member 20, thus enabling secure positioning of scoop member 20 within support member 50.

Figure 2:
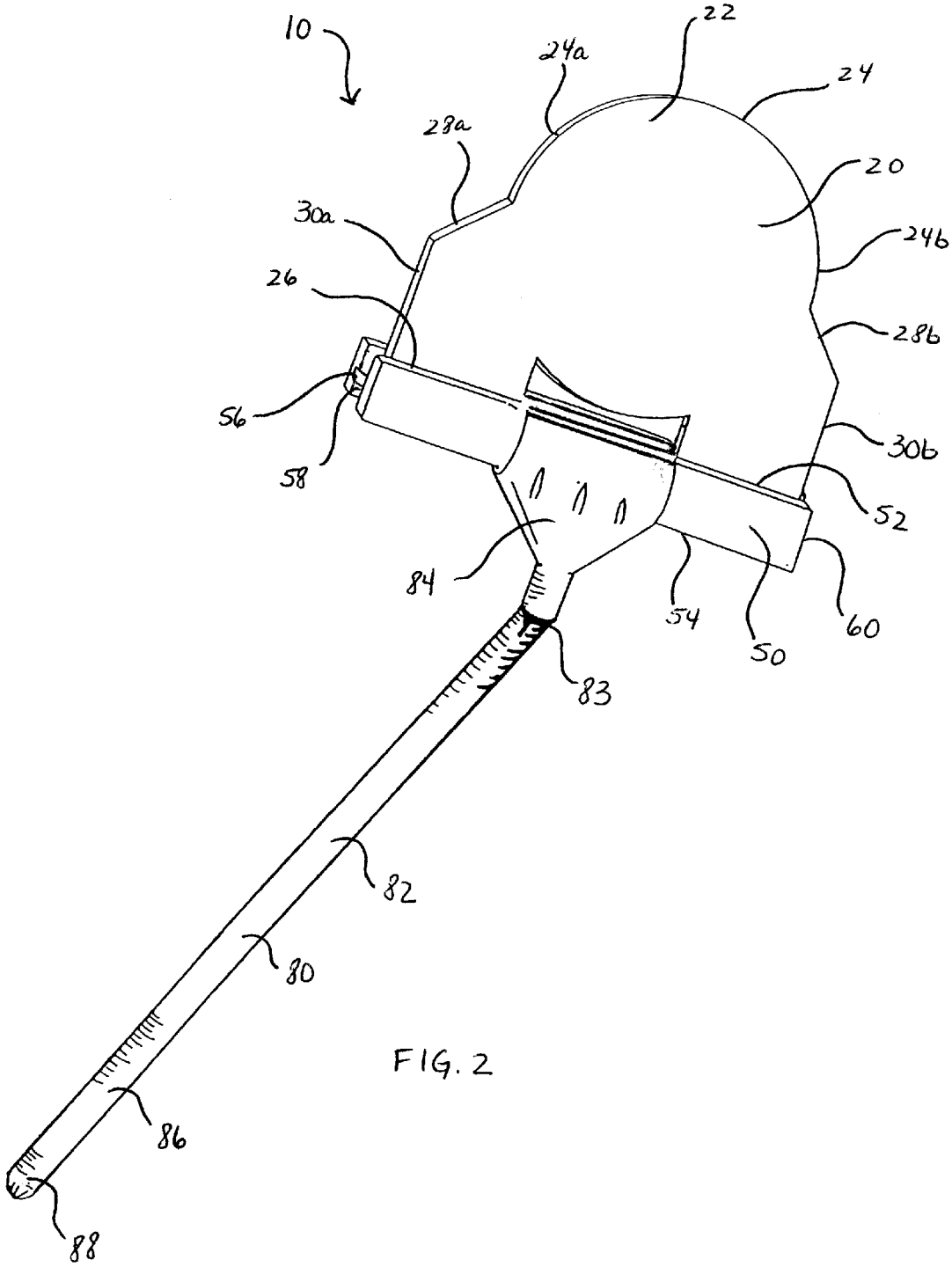
FIG. 2 is a perspective view of a concrete chute shovel apparatus according to an alternate embodiment of the present invention.

Elongated arm 80 extends from handle side 54 of support member 50, substantially perpendicular thereto, thus defining elongated handle 82. Preferably, elongated handle 82 is substantially straight, substantially cylindrical and has a fixed length to accommodate comfortable usage by a majority of individuals. While a substantially straight elongated handle 82 is preferred, at least one angle 83 could alternatively be provided therein, as best seen in FIG. 2, to accommodate potential variations in concrete chute angles, or angle 83 could be mechanically adjustable to enable user selection of a variety of angles. Elongated handle 82 is preferably carried in threaded support bracket 84, wherein threaded support bracket 84 is carried by support member 50. However, one skilled in the art based on the present disclosure would readily recognize that elongated handle 82 could also be integrally formed with support member 50, that threaded support bracket 84 could be integrally formed with support member 50 or that elongated handle 82 could be a one-piece unit carried by support member 50, as shown in FIG. 5.

Preferably, scoop member 20 is plastic, thereby facilitating disposal and replacement thereof. However, one skilled in the art would readily recognize that alternative materials could be utilized such as, for exemplary purposes only, rubber, fiberglass, metal, wood or composite material. Support member 50 and elongated handle 80 are preferably formed from lightweight yet sturdy metal such as, for exemplary purposes only, aluminum. However, one skilled in the art would readily recognize that other suitably strong, yet portable materials could be utilized such as, for exemplary purposes only, plastic, fiberglass, wood or other composite material.

In an alternate embodiment, scoop member 20 could be permanently affixed to support member 50.

Figure 5:
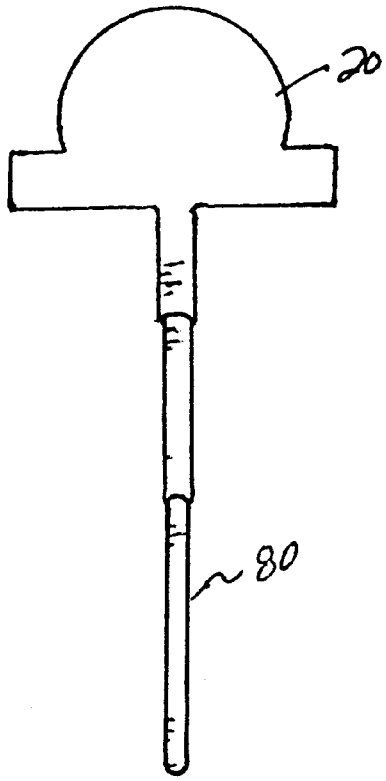
FIG. 5 is front view of a concrete chute shovel apparatus according to an alternate embodiment.

In an alternate embodiment, scoop member 20 could be integrally formed with support member 50, as shown in FIG. 5.

In an alternate embodiment, support arm 50 could carry a locking hinge-type mechanism wherein scoop member 20 could be securely and replaceably retained thereby.

In an alternate embodiment, elongated handle 82 could have telescopically interconnecting sections, thereby enabling adjustable length thereof.

In an alternate embodiment, outer surface 86 of elongated handle 82 could carry striations, grooves, rubber or other grip-enhancing feature.

In an alternate embodiment, distal end 88 of elongated arm 80 could have an aperture defined therethrough or a looping member carried thereon, thereby enabling convenient hanging placement of concrete chute shovel apparatus 10.

In use, concrete chute shovel apparatus 10 aids in the placement of concrete for building walkways, concrete floors and other areas where beds of concrete are being laid, wherein a user grasps elongated handle 82 thereby extending his or her reach up into the discharge chute of a cement truck. The user directs the substantially arcuate extended edge 24 into the inner "U"-shaped trough of the concrete chute, wherein guiding edges 28*a* and 28*b* effectively rest on the chute edges. User controlled movement of elongated handle 82 directs scoop member 20 for shoveling, pulling, plugging or otherwise controlling the flow of concrete. When scoop member 20 becomes worn, the user easily removes scoop member 20 from support member 50, sliding in a replacement and thus avoiding discarding the entire tool.

Having thus described exemplary embodiments of the present invention, it should be noted by those skilled in the art that the within disclosures are exemplary only, and that various other alternatives, adaptations, and modifications may be made within the scope of the present invention. Accordingly, the present invention is not limited to the specific embodiments illustrated herein, but is limited only by the following claims.

What is claimed is:

1. A shovel device for a concrete chute, comprising:

a substantially planar scoop member having a substantially arcuate outer edge, a support edge and outwardly extending, opposingly positioned placement guides proximate to said arcuate outer edge;

a support member, wherein said support edge of said scoop member is carried by said support member and wherein said support edge of said scoop member and said support member are substantially parallel; and an elongated arm, said elongated arm carried by said support member.

2. The shovel device for a concrete chute of claim 1, wherein said substantially planar scoop member is removably carried by said support member.

3. The shovel device for a concrete chute of claim 2, wherein said substantially planar scoop member is slidably received by said support member.

4. The shovel device for a concrete chute of claim 2, wherein said scoop member is hingedly locked within said support member.

5. The shovel device for a concrete chute of claim 1, wherein said elongated arm carries a grip thereon.

6. The shovel device for a concrete chute of claim 1, wherein said elongated arm carries a hanging throughhole.

7. A chute scoop, comprising:

a blade member having a first rounded end and outwardly extending, opposingly positioned placement guides proximate to said first rounded end;

a receiving member, said receiving member having a receptacle defined therein for removably receiving said blade member, and said receiving member having a support bracket carried thereby, said support bracket having a threaded female receptacle defined therein; and an elongated handle, said elongated handle having a first gripping end and a second threaded end, wherein said threaded end is dimensioned to be received and retained within threaded female receptacle of said support bracket.

8. The shovel device for a concrete chute of claim 1, wherein said elongated arm is positioned at an angle relative to support member such that said elongated arm is not perpendicular or parallel with said support member.

9. The chute scoop of claim 7, wherein said elongated handle is angled relative to said blade member.

10. The chute scoop of claim 7, wherein said elongated handle is telescopically collapsible.

11. The chute scoop of claim 7, wherein said gripping end of said elongated handle has at least one grip carried thereon.

12. The chute scoop of claim 7, further comprising at least one hanging aperture.

13. A trough tool for utilization in a dispensing chute of a concrete truck, comprising:

a blade member having a first rounded end, a pair of outwardly extending, opposingly positioned placement guides proximate to said first rounded end and a mounting end;

a receiving member, said receiving member having an elongated receptacle defined therein for slidably and removably receiving said mounting end of said blade member, and said receiving member having a support bracket carried thereby, said support bracket having a threaded female receptacle defined therein; and an elongated handle, said elongated handle having a first gripping end and a second threaded end, wherein said threaded end is dimensioned to be received and retained within threaded female receptacle of said support bracket.

* * * * *